US007058984B2

(12) United States Patent
Newman

(10) Patent No.: US 7,058,984 B2
(45) Date of Patent: Jun. 13, 2006

(54) GOLF GLOVES

(76) Inventor: Peter J. Newman, 2046 Treasure Coast Plz., #313, Vero Beach, FL (US) 32960

( * ) Notice: Subject to any disclaimer, the term of this patent is extended or adjusted under 35 U.S.C. 154(b) by 368 days.

(21) Appl. No.: 10/664,401

(22) Filed: Sep. 18, 2003

(65) Prior Publication Data

US 2005/0060785 A1 Mar. 24, 2005

(51) Int. Cl.
*A41D 19/00* (2006.01)

(52) U.S. Cl. ..... 2/161.2; 2/161.1

(58) Field of Classification Search ..... 2/16, 2/20, 159, 160, 161.1, 161.2, 161.6; 473/205
See application file for complete search history.

(56) References Cited

U.S. PATENT DOCUMENTS

| | | | | | |
|---|---|---|---|---|---|
| 2,258,999 | A | * | 10/1941 | Nunn | 2/159 |
| 2,270,882 | A | * | 1/1942 | Link | 2/159 |
| 2,302,875 | A | * | 11/1942 | Lykins | 2/161.3 |
| 2,456,678 | A | * | 12/1948 | Cole | 2/159 |
| 2,710,970 | A | | 6/1955 | Kennedy | 2/159 |
| 2,877,465 | A | * | 3/1959 | Stroud | 2/20 |
| 3,065,472 | A | | 11/1962 | Linnell | 2/161 |
| 3,648,292 | A | | 3/1972 | Strickler | 2/161 A |
| 3,848,874 | A | | 11/1974 | Elkins, Jr. | 273/183 B |
| 3,863,271 | A | * | 2/1975 | Moroney | 2/161.2 |
| 4,000,903 | A | * | 1/1977 | Swanson | 473/205 |
| 4,329,741 | A | * | 5/1982 | Bach | 2/161.2 |
| 4,665,565 | A | | 5/1987 | Odom | |
| 4,962,547 | A | | 10/1990 | Minnick | 2/161 A |
| 5,253,367 | A | * | 10/1993 | Lappley | 2/161.3 |
| 5,634,214 | A | * | 6/1997 | St. Ville | 2/161.2 |
| 5,983,397 | A | | 11/1999 | Seminara | 2/161.1 |
| 6,088,834 | A | | 7/2000 | Seminara | 2/161.1 |
| 2002/0129437 | A1 | | 9/2002 | Erker | |

FOREIGN PATENT DOCUMENTS

| | | |
|---|---|---|
| GB | 2232338 | 12/1990 |

* cited by examiner

*Primary Examiner*—Gary L. Welch
(74) *Attorney, Agent, or Firm*—Peter S. Canelias

(57) ABSTRACT

According to this invention, a conventional pair of golf gloves is provided with pads across the palm portions thereof which abut the grip portion of a golf club shaft to automatically align the shaft for proper gripping. The guide pads are so positioned across the palm portions of the gloves that when the golf club head is soled on the ground and the upper and lower gripping hands of a golfer wearing the gloves receive the grip portion of the club shaft across the palms of the glove and against the pads, the shaft will lie diagonally across the roots of the fingers and when the hands are closed around the shaft with the guide pads cradling the grip portion of the golf club distal from the golf club head, an automatic proper gripping of the golf club will be insured. The guide pads are substantially parallel to the transverse creases of the hand, lying diagonally across the roots of the fingers. The pad on the first glove spans substantially the entire palm of the hand. The pad on the second glove spans from about the outer edge of the index finger to about the middle of the metacarpal-phalangeal joint of the second finger of the hand. Differences between the lengths of the pads allow the use of the gloves without one pad impinging upon the other.

7 Claims, 3 Drawing Sheets

GOLF GLOVES

BACKGROUND OF THE INVENTION

This invention relates to golf gloves having cooperating guide pads to insure proper gripping of a golf club. More particularly, the invention relates to an improved pair of golf gloves having elongated guide pads of differing lengths disposed on the palm portions of each respective glove. Each guide pad urges the distal, gripping end of a golf club to nest adjacent the knuckles of each hand in a proper grip, aligning the distal end of the golf club within the golfer's hands.

Various attempts have been made to modify a conventional golf glove to improve a golfer's grip on the club. Several types of golf gloves have been developed wherein one or more pads are formed on the finger or palm portion of a single golf glove in order to urge the golf club gripping portion into proper grip alignment in the hand. Some of these gloves are known to incorporate padding on the palm portion of the glove to assist in the proper grip of a golf club. Examples of these gloves are shown in U.S. Pat. No. 4,000,903 to Swanson; U.S. Pat. No. 3,863,271 to Moroney; U.S. Pat. No. 2,258,999 to Nunn; U.S. Pat. No. 4,329,741 to Bach; U.S. Pat. No. 3,648,292 to Strickler; and U.S. Pat. No. 5,253,367 to Lappley.

It is also known in the art to have a golf glove that contains a visual indicator which assists in the proper grip of the golf club grip. Examples of these indicators are shown in U.S. Pat. No. 3,848,874 to Elkins; U.S. Pat. No. 4,962,547 to Minnick; and U.S. Pat. No. 5,634,214 to St. Ville.

However, there are still problems commonly encountered in playing golf that are not addressed by the gloves of the prior art. A problem with visual indicators is that they do not automatically position the hands in the correct position, nor allow for the feel of the club in the hand to govern slight variances in position. The golfer, when using such a visual indicator, must distract himself from the ball, the course, maintaining a proper stance, etc. in order to view and align the golf club gripping portion in line with the indicator. And, while swinging, the visual indicator is incapable of keeping the proper grip through the swing.

One of the problems with existing padded golf gloves is that only one glove is configured to establish a proper golf grip, leaving the second hand without any guidance. Use of two of the prior art golf gloves, if at all feasible, results in the pads impinging upon one another or otherwise failing to adjust for a two-handed grip. There is a great need for either a cooperating pair of golf gloves or for a single golf glove adapted for use on a second hand when used in conjunction with a first conventional golf glove having some pad arrangement.

SUMMARY OF THE INVENTION

According to this invention, a conventional pair of golf gloves is provided with pads across the palm portions thereof which in use will abut the grip portion of a golf club shaft to automatically align the shaft for proper gripping. The guide pads are so positioned across the palm portions of the gloves that when the golf club head is soled on the ground and the upper and lower gripping hands of a golfer wearing the gloves receive the grip portion of the club shaft across the palms of the glove and against the pads, the shaft will lie diagonally across the roots of the fingers. Then, when the hands are closed around the shaft with the padded pads cradling the grip portion of the golf club distal from the golf club head, an automatic proper gripping of the golf club will be insured. The guide pads are substantially parallel to the distal transverse crease of the hand, lying diagonally across the roots of the fingers. The pad on the first glove preferably spans substantially the entire palm of the hand. The pad on the second glove preferably spans from about the outer edge of the index finger to about the middle of the metacarpal-phalangeal joint of the second finger of the hand. Since the grip portion of the shaft is tapered the guide pads may be canted from a line paralleling the proper finger gripping line by an amount equivalent to the taper of the shaft.

The guide pads are formed of different lengths and disposed complementary to one another on the respective palm portions of each glove, so that each hand may be positioned in any proper two-handed grip without the pads interfering with or overlapping one another. This allows full proper positioning of both hands even where the golfer employs an interlocking finger grip comprised of interlocking two fingers of each hand over the club.

The guide pads are preferably formed of cylindrical leather sheaths closed at both ends and sewn into the palm portions of the gloves. The sheaths preferably form pockets to house semi-rigid padding material, preferably Styrofoam or a similar foam-type product, causing the sheaths to maintain an outer convex surface configured to cradle the gripping portion of a golf club, where the sheaths are capable of movement about the gripping portion so as to conform with a variety of club handles and allow the golfer to use his own equipment without specially adapted gripping portions. The guide pads are spaced away from the bases of the fingers by a distance that causes the pads to partly wrap around the golf club grip and urge the grip towards the knuckles and away from the heels of the hands when a gripping pressure is applied to the golf club. Because the padded sheaths overlie the shaft, allowing the grip to rest against the gloved hand, the golfer will retain the same comfortable grip and "feel" of the club shaft that is available with a conventional golf glove. The guide pads are generally cylindrical in shape and have a width sufficient to urge the golf club gripping portion into proper position, but not so wide as to abut the heels of the hand, which would impair the feel of the club and limit the ability of the hands to be wrapped around the grip portion.

It is then an object of this invention to provide a pair of golf gloves with guide pads that will insure proper gripping of the golf club shaft.

Another object of the invention is to provide a conventional golf glove with a cooperating pair of guide pads extending across the palm portions of the gloves and positioned to abut the grip portion of a golf club shaft to automatically place the both gripping hands of a golfer into proper two-handed grip position without impinging upon one another.

A further object of the invention is to provide guides for a proper golf grip that may be adapted to any conventional golf gloves.

Another object of the invention is to provide a golf glove for the upper gripping hand of a golfer which when receiving there against the shaft of a golf club soled on the ground, will automatically present the hand of the golfer to the shaft in a proper gripping position.

Another object of the invention is to provide a golf glove for the lower gripping hand of a golfer which when receiving there against the shaft of a golf club soled on the ground, will automatically present the hand of the golfer to the shaft in a proper gripping position.

Another object of the present invention is to provide an improved pair of golf gloves that allow the golfer to retain the feel of the golf club.

Another object of the invention is to provide a pair of golf gloves with pads that retain the golf club shaft in proper position throughout the swing of the club.

A further object of the present invention is to provide a single golf glove with a guide pad so arranged as to not interfere with the use of a second golf glove having some form of padding or ridge.

Other and further objects of this invention will be apparent to those skilled in the art from the following detailed description and the accompanying drawings which show a preferred embodiment of the invention.

DETAILED DESCRIPTION

The drawings are directed to a pair of gloves for a right-handed golfer, but it should be understood that the invention also covers gloves for left-handed golfers since the guide pads of the invention apply to the upper and lower gripping hands of a golfer regardless of whether he is right or left-handed.

Figure 1:
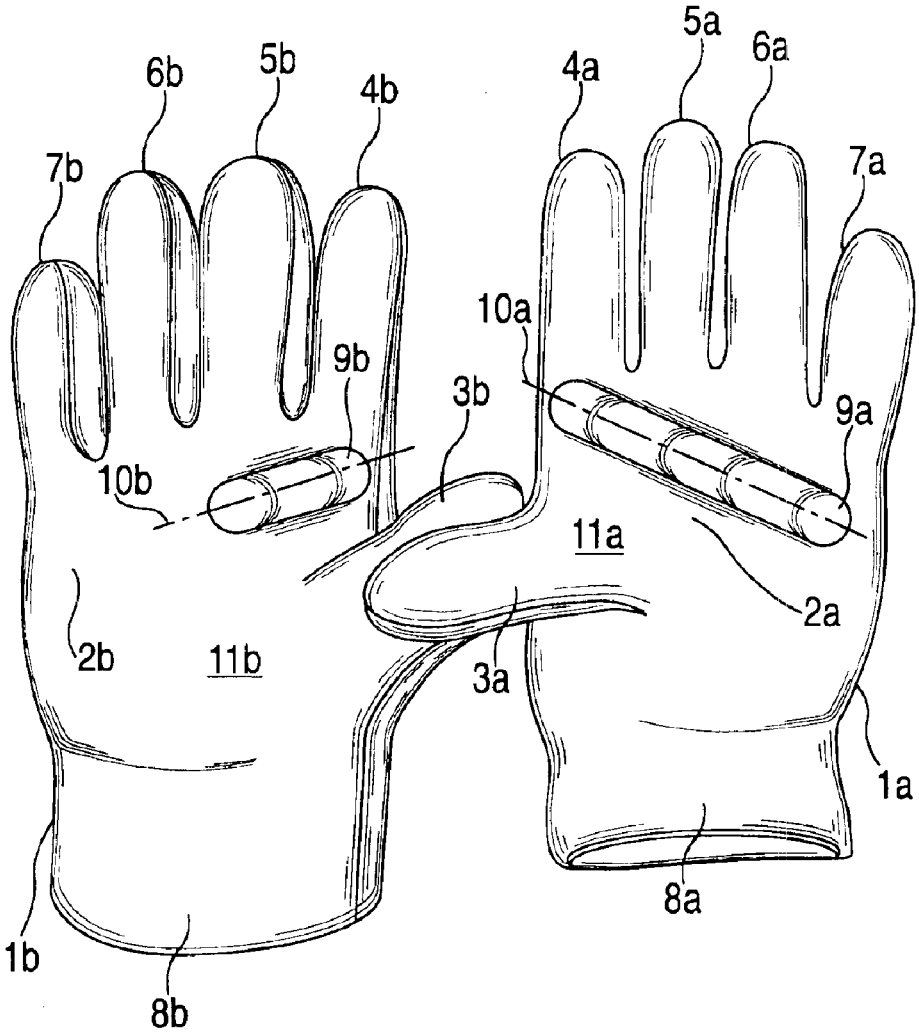
FIG. 1 is a plan view of the palm portions of the golf gloves in accordance with the invention.

The golf gloves 1*a* and 1*b* shown in FIG. 1 are full-fingered kid leather golfer's gloves with palm portions 2*a* and 2*b*, thumb portions 3*a* and 3*b*, index finger or forefinger portions 4*a* and 4*b*, second or middle finger portions 5*a* and 5*b*, ring finger or third finger portions 6*a* and 6*b*, little finger or fourth finger portions 7*a* and 7*b*, and wrist portions 8*a* and 8*b*. It will be understood that this glove construction is conventional and only illustrative of golfers' gloves that can be modified to include the guide pads of this invention. The gloves can be made out of any suitable material, such as leather or synthetic material. The gloves 1*a* and 1*b* may be replaced with other golfer's glove designs including those with partial thumb and finger portions, and may be secured about the wrist using Velcro® or other hook and loop-type fasteners, snap fasteners, laces or other means for securing the gloves, since the guide pads of this invention are adaptable to all such types of golfers' gloves.

The gloves 1*a* and 1*b* of the current invention include raised pads 9*a* and 9*b* on the palm portion 2*a* and 2*b* respectively. The pads 9*a* and 9*b* are positioned on the palm portions 2*a* and 2*b* of the gloves such that when the user's hands are inserted into the gloves 1*a* and 1*b*, the pads 9*a* and 9*b* reside adjacent the glove portions overlying the metacarpal-phalangeal joints of the hand. Pads 9*a* and 9*b* restrict torsional movement of the glove material and underlying skin covering the metacarpal-phalangeal joints during a golf club swing. When a golf club is gripped with the gloves 1*a* and 1*b* of the present invention, pads 9*a* and 9*b* facilitate placement of the grip adjacent the proximal phalanges of the user's hands. This causes the club to be gripped by the fingers rather than with palm of the hand in a correct gripping position.

As shown in FIG. 1, the pads 9*a* and 9*b* extend diagonally across the roots of the fingers from about the outer edge of the index or forefingers of the gloves along lines 10*a* and 10*b* substantially parallel to a transverse crease of the palm of the hand of a user. It is understood that due to individual variances in the transverse creases of the palm of the hand, including less than fully linear creases on the hands of some individuals, the tracking of the slope of the transverse creases is approximate. In general, however, the lines of transverse creases indicate the correct position for the grip portion of a golf club shaft when the club is soled on the ground and the grip portion is cradled in the open palms of the hands. The pads 9*a* and 9*b* are positioned substantially parallel to the lines 10*a* and 10*b* respectively, and are also spaced a distance above those portions of the gloves 11*a* and 11*b* covering the thenar eminence of the hand. Since the conventional golf club shaft is tapered at the zone gripped by the upper hand, the pads 9*a* and 9*b* may converge slightly toward the line formed by the transverse creases to accommodate the taper.

The pad 9*a* of glove 1*a* extends from about the outer edge of the index or forefinger portion 4*a* to about the outer edge of the little finger portion 7*a*, spanning substantially the entire palm portion 2*a*. The pad 9*b* of glove 1*b* extends from about the outer edge of the index or forefinger 4*b* to about the middle of the second or middle finger portion 5*b*. The pad 9*b* has a length shorter than the pad 9*a* so that the gloves urge a proper, two-handed grip without the pads 9*a* and 9*b* interfering with or impinging upon one another. It should be understood that it is the relative lengths of the guide pads that are important to the invention, rather than the specific lengths of an individual guide pad. The relative lengths shown in this preferred embodiment are sized to accommodate a variety of grips without one guide pad impeding or overlapping the other, even where a user employs a close grip such as interlocking first two fingers of the upper hand with the second two fingers of the lower hand.

To achieve the desired comfort and grip enhancement with the present invention, the diameter of the pads 9*a* and 9*b* may be varied with the size of the gloves and with the size and taper of the golf club gripping portions of the clubs. In this preferred embodiment, the pads 9*a* and 9*b* should be about eight millimeters in diameter and generally cylindrical in shape, with the core padding being of a thickness sufficient to support the outer surface of the sheath without undue lapping or creasing of the glove material overlying the inner padding.

Figure 2:
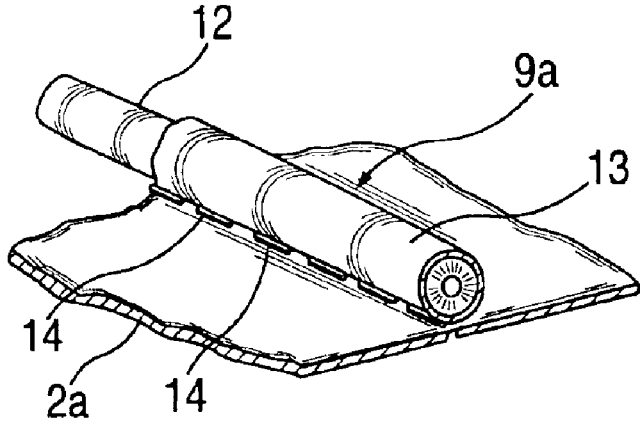
FIG. 2 is a transverse sectional view of a guide pad in accordance with the invention.

As shown in FIG. 2, the pad 9*a* (used here for illustration, the construction of the pad being substantially the same as that for pad 9*b*) is formed from a cylindrical foam core 12 which may be composed of Styrofoam, plastic or rubber rods or similar relatively stiff but bendable and somewhat resilient material. The pad 9*a* of FIG. 2 preferably provides longitudinal stiffness and radial resilience thereby preventing the pad from creasing, folding over, or collapsing. At the same time, however, the pads 9*a* and 9*b* are sufficiently deformable so as to follow the contours of the golfer's hands, as well as the taper of the gripping portion of the golf club. As shown in FIG. 2, the core 12 is encased by a sheath 13, the sheath 13 preferably formed of the same glove material forming the palm portion 2*a*. The pad 9*a* is secured to the palm portion 2*a* by stitching 14 along the length thereof on the underside of sheath 13 to the palm portion 2*a*. The stitching 14 can be replaced with adhesive or other bonding material.

Figure 3:
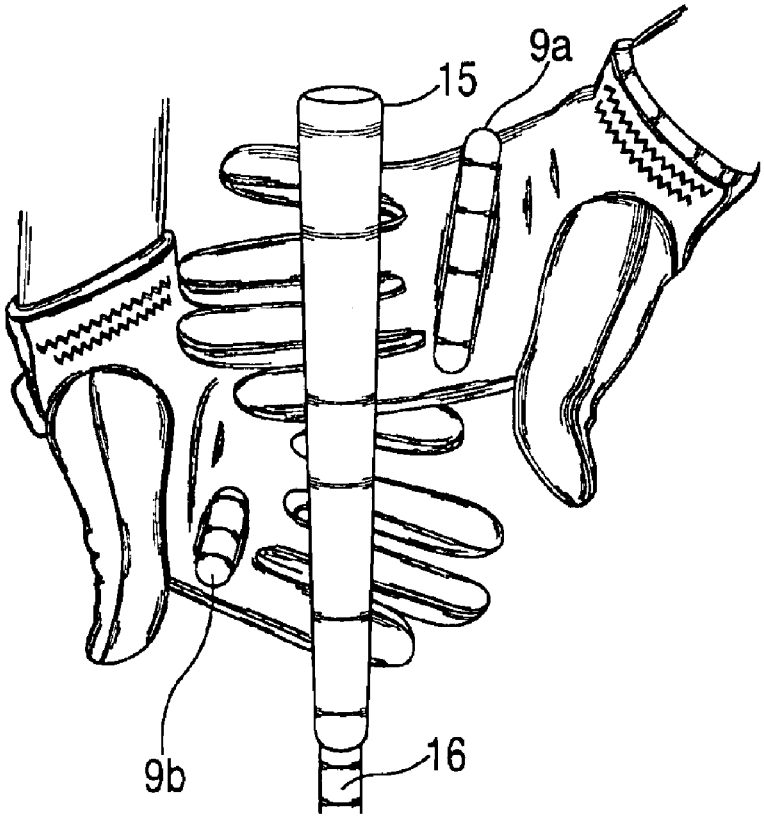
FIG. 3 is a perspective view of a golfer's left and right hands wearing the gloves of this invention and approaching the grip portion of a golf club shaft.
Figure 4:
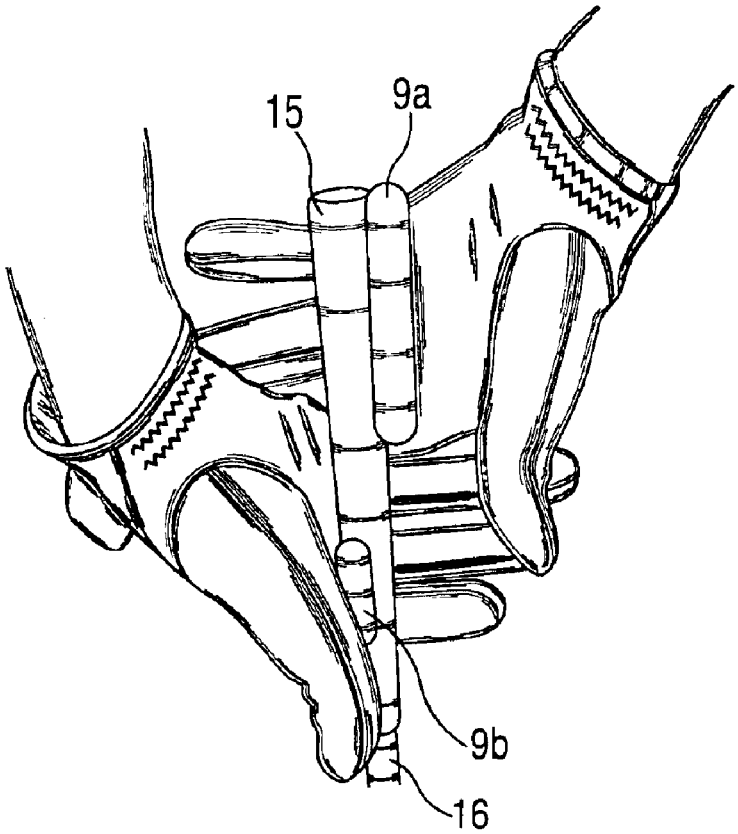
FIG. 4 is a perspective view of a golfer's left and right hands wearing the gloves of this invention where the respective pads are seated against the grip portion of a golf club shaft before closing the grip.

As shown in FIGS. 3 to 4, a tapered gripping portion 15 of a golf club shaft 16 extending from the head to the gripping portion 15 is being grasped by a wearer of the gloves 1*a* and 1*b* with the palms 2*a* and 2*b* of the gloves being initially cupped around the gripping portion 15 to abut the gripping portion 15 along the lengths of the pads 9*a* and 9*b* as shown in FIG. 4. Then, the fingers are wrapped around the gripping portion 15 as shown in FIG. 4, and the pads 9*a* and 9*b* will automatically align the gripping portion 15 and the shaft 16 along a line substantially parallel to the transverse creases of the hands to insure a proper grip.

A conventional golf club shaft has a gripping zone for the left-hand that tapers from a diameter of about one-inch at the heel of the hand to a diameter of about seven-eights of an inch at the thumb portion of the hand. Thus the shaft decreases about one-eighth inch in diameter along the grip portion thereof that is spanned by the left-hand of the golfer. The pad 9*a* to align the golf club shaft 16 in a line 10*a* (FIG. 1) parallel to the transverse creases of the hand should then converge about one-eighth of an inch toward the line from its heel and to its thumb-end.

In use, the player would place the gloves 1*a* and 1*b* on his hands. The glove 1*a* is usually worn on the hand placed highest on the golf club shaft when the club is gripped. Once the glove 1*a* is placed on the proper hand, the player would select a club and address the ball prior to striking the ball. The player then grips the golf club gripping portion 15 with his gloved hands. At this point the player could determine whether he has properly gripped the club by the feel of the alignment of the gripping portion 15 along the guide pads 9*a* and 9*b*. When the gripping portion 15 is aligned along the guide pads 9*a* and 9*b* then the player is properly gripping the golf club. If the alignment is not complete the player, while still addressing the ball, may rotate his hands on the grip until the pads 9*a* and 9*b* are in appropriate alignment, since the wearer will be able to feel the tortional movement and resistance from the abutment of the pads 9*a* and 9*b* to the gripping portion 15.

Figure 5:
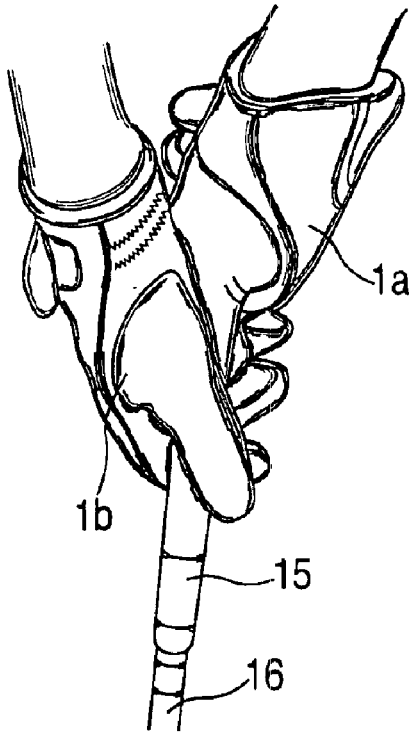
FIG. 5 is a perspective view similar to FIG. 4 but showing the closed grip position of the golfer's hands about the grip portion of a golf club.

The pads 9*a* and 9*b* not only automatically properly align the golfer's hands relative to the golf club shaft 16, but also, as shown in FIG. 4, afford an abutment to maintain this alignment after the shaft is firmly gripped by the golfer as shown in FIG. 5. Misalignment after initial gripping is therefore prevented.

FIG. 5 shows the closed grip position of the golfer's hands about the grip portion of a golf club. Where the golfer's hands are placed so that the pads 9*a* and 9*b* properly abut the gripping portion 15 of the golf club the hands remains in proper grip position during and after closure of the hands about the shaft and through the entire swing and follow-through.

While the invention has been described with references to certain preferred embodiments those skilled in the art will recognize that modifications and variations may be made in construction and material without departing from the spirit and scope of the present invention, which is intended to be limited only by the scope of the claims appended hereto.

I claim:

1. A pair of golf gloves comprising:

a first glove having a palm portion;

a raised elongated guide pad extending diagonally across a portion of the palm portion between a thumb portion and a finger portion and secured to the palm portion;

the guide pad being substantially parallel to a transverse crease of a hand and extending across the palm portion of the golf glove for a distance between a first position corresponding to a first end of the guide pad and a second position corresponding to a second end of the guide pad;

a second glove having a second palm portion;

a second raised elongated guide pad extending diagonally across a portion of the second palm portion between a second thumb and second finger portions and secured to the second palm portion; and the second guide pad being substantially parallel to a transverse crease of a second hand and extending across the second palm portion of the second golf glove.

2. The pair of golf gloves of claim 1, wherein the first and second guide pads have a cross section diameter of about eight millimeters.

3. The pair of golf gloves of claim 1 wherein the first position of the first glove is about an exterior edge of a forefinger portion of the first glove and the second position is about a midpoint of a second finger portion of the first glove.

4. The pair of golf gloves of claim 1 wherein the second guide pad extends across substantially the entire second palm portion of the second glove.

5. The pair of golf gloves of claim 1 wherein the first and second guide pads are each comprised of a sheath substantially surrounding a core.

6. The pair of golf gloves of claim 5 wherein the core is substantially cylindrical in shape.

7. The pair of golf gloves of claim 5 wherein the core is comprised of substantially rigid foamed material.

* * * * *